US007500623B2

(12) United States Patent
Paris et al.

(10) Patent No.: US 7,500,623 B2
(45) Date of Patent: Mar. 10, 2009

(54) PROCESS FOR THE TREATMENT OF A NUCLEAR GRAPHITE CONTAMINATED WITH RADIOELEMENTS BY MILLING THE SAID GRAPHITE IN A LIQUID MEDIUM

(75) Inventors: Jacques Paris, Bagnols/Ceze (FR); Jean-Raymond Costes, Uchaux (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/498,259

(22) PCT Filed: Dec. 10, 2002

(86) PCT No.: PCT/FR02/04254

§ 371 (c)(1),
(2), (4) Date: Jun. 9, 2004

(87) PCT Pub. No.: WO03/049865

PCT Pub. Date: Jun. 19, 2003

(65) Prior Publication Data

US 2005/0051644 A1 Mar. 10, 2005

(30) Foreign Application Priority Data

Dec. 11, 2001 (FR) ..... 01 15973

(51) Int. Cl.
*B02C 19/00* (2006.01)

(52) U.S. Cl. ..... 241/1; 241/301

(58) Field of Classification Search ..... 241/1, 241/15, 301; 204/168, 173; 588/20
See application file for complete search history.

(56) References Cited

U.S. PATENT DOCUMENTS

| | | | | |
|---|---|---|---|---|
| 3,352,503 | A * | 11/1967 | Maroudas | 241/301 |
| 3,458,417 | A * | 7/1969 | Deiber et al. | 204/173 |
| 3,529,776 | A * | 9/1970 | Lajos | 241/1 |
| 3,770,212 | A | 11/1973 | Kassir et al. | |
| 4,279,710 | A | 7/1981 | Coughlin | |
| 4,566,961 | A | 1/1986 | Diaz et al. | |

(Continued)

FOREIGN PATENT DOCUMENTS

| | | |
|---|---|---|
| DE | 247 858 A1 | 7/1987 |

(Continued)

OTHER PUBLICATIONS

Office Action received from U.S. Patent and Trademark Office for copending U.S. Appl. No. 10/498,700, mailed Feb. 26, 2008.

(Continued)

*Primary Examiner*—Bena Miller
(74) *Attorney, Agent, or Firm*—Brinks Hofer Gilson & Lione

(57) ABSTRACT

A process for the milling of a nuclear graphite contaminated with radioelements includes subjecting the graphite, immersed in a liquid medium, to high-voltage pulses. The liquid medium has a resistivity such that, owing to the effect of the energy conveyed by the said pulses, electric arcs are initiated and, upon contact with the graphite, break the carbon-carbon bonds that make up the graphite. The number of high-voltage pulses is set so as to obtain a given particle size.

6 Claims, 2 Drawing Sheets

U.S. PATENT DOCUMENTS

| | | | | |
|---|---|---|---|---|
| 5,159,900 | A | 11/1992 | Dammann | |
| 5,792,325 | A * | 8/1998 | Richardson, Jr. | 204/164 |
| 6,200,430 | B1 | 3/2001 | Robert | |
| 6,319,391 | B1 * | 11/2001 | Holderness et al. | 205/768 |
| 6,972,118 | B2 | 12/2005 | Santilli | |

FOREIGN PATENT DOCUMENTS

| | | | |
|---|---|---|---|
| DE | 195 34 232 | A1 | 3/1997 |
| FR | 1 423 592 | A | 3/1966 |
| FR | 2 691 524 | | 11/1993 |
| JP | 11202093 | | 7/1999 |
| WO | WO 03/050208 | | 6/2003 |

OTHER PUBLICATIONS

International Search Report completed Aug. 21, 2003, in International Application No. PCT/FR2002/04253, which was the International Phase of corresponding U.S. Appl. No. 10/498,700.

* cited by examiner

PROCESS FOR THE TREATMENT OF A NUCLEAR GRAPHITE CONTAMINATED WITH RADIOELEMENTS BY MILLING THE SAID GRAPHITE IN A LIQUID MEDIUM

TECHNICAL FIELD

The subject of the present invention is a process for the treatment of a nuclear graphite contaminated with radioelements by milling the said graphite immersed in a liquid medium, especially of the graphite coming from the NUGG (Natural Uranium-Graphite-Gas) system recovered during dismantlement or the nuclear graphite coming from nuclear sites during nuclear clean-up operations.

PRIOR ART

The general field of the invention is therefore that of the treatment of nuclear waste, such as nuclear graphite contaminated with radioelements.

At the present time, one of the nuclear graphite treatment processes consists in subjecting the said graphite to dry fragmentation, in air, by the use of conventional milling means, such as percussion mills or roll mills, so as to obtain a powder which is then subjected to a combustion operation in order to completely destroy the contaminated graphite.

However, this treatment process has the following drawbacks:

- this process is a very expensive process, insofar as the graphite has a hardness such that it causes rapid wear of the mechanical components used in making the mills, thereby requiring the said components to be frequently renewed;
- this process causes the formation of very fine graphite particles which, when they are in suspension in the air, may cause an explosion when a spark occurs; and
- this process causes substantial pollution due in particular to the volatility of the graphite particles, it being possible for these particles to be laden optionally with radioactive heavy metals, such as $^{60}Co$ and $^{137}Cs$, thereby requiring containment of the milling station so as to avoid any leakage into the open air of contaminating radioactive elements; however, the establishment of such containment does not thereby prevent dispersion of volatile radioelements, such as tritium, which may escape via the ventilation systems of the station.

DESCRIPTION OF THE INVENTION

Thus, the object of the present invention is to propose a process for the treatment of a nuclear graphite contaminated with radioelements, which does not have the drawbacks of the prior art and which, in particular, does not require the use of mechanical components and which does not cause the dispersion of radioelements and also obviates the risks of a powder explosion.

To achieve this, the subject of the invention is a process for the treatment of a nuclear graphite contaminated with radioelements, the said process comprising a milling step consisting in subjecting the said graphite, immersed in a liquid medium, to high-voltage pulses, the said liquid medium having a resistivity such that, owing to the effect of the energy conveyed by the said pulses, electric arcs are initiated and, upon contact with the said graphite, break the carbon-carbon bonds that make up this graphite, the number of high-voltage pulses being set so as to obtain graphite particles of a given particle size.

It should be mentioned that, according to the invention, the term "high-voltage pulses" is understood to mean electrical pulses that can convey a voltage of the order of one or more kilovolts resulting in the creation of electrical arcs in a liquid medium having resistivity properties suitable for arc formation. Thus, for the purpose of implementing this process, liquid media with a resistivity of greater than 1 MΩ.cm may advantageously be used.

This process has the advantage of being able to carried out without the use of mechanical milling components, thereby minimizing the running costs of this process compared with those of the prior art.

In addition, this treatment process has the advantage of being carried out in a liquid medium. Consequently, the graphite powders resulting from the milling are trapped in this liquid medium, and this prevents the abovementioned powder explosion phenomenon. In addition, the radioelements released during the milling of the graphite remain confined in the liquid medium, for example by isotope exchange, as is the case with tritium.

Apart from the release and the trapping of the radioelements, the process according to the invention makes it possible to obtain, after its completion, graphite particles of a given particle size, which particles may either be subjected to a combustion operation, so as to completely destroy them, or may be recovered, for the purpose of possibly reusing them, for example as a base product for geological barriers constructed for a long-term storage of highly radioactive substances. These particles may also be stored under conditions in which there is no bleaching by surface water.

According to the invention, to mill the nuclear graphite into the form of relatively fine particles, a person skilled in the art can readily choose the high-voltage pulse application conditions (energy, frequency, duration and number of pulses delivered) depending on the nature of the initial graphite, it being understood that the higher the energy of the pulses the fewer the number of pulses to be applied in order to obtain a given particle size.

According to the invention, the energy conveyed by each pulse may advantageously be between 10 J and 100 kJ, preferably equal to 1 kJ.

According to the invention, the high-voltage pulses may advantageously have a duration ranging from around from 100 ns to 100 μs, preferably with a duration of 1 μs.

According to the invention, the high-voltage pulses may have a frequency ranging from 1 Hz to 1000 Hz, preferably 10 Hz. It should be clearly understood that this frequency will be specifically set by a person skilled in the art depending on the generator used.

According to one particularly advantageous embodiment of the invention, one liquid medium that can be used within the context of this process is water. It should be clearly understood that the water used within the context of the invention will advantageously have resistivity properties such that an electric arc can be initiated through the effect of the high-voltage pulses. For example, the water used may be partially deionized, so as to have a lower conductivity than water that has not undergone any treatment.

Advantageously, the process of the invention may also include a treatment step carried out on the liquid medium in which the graphite milling takes place, this treatment being a conventional treatment intended, especially when this liquid medium is water, for purifying the liquid medium of the radioelements released and for maintaining its resistivity, these treatments being within the competence of a person skilled in the art. The treatment of the liquid medium, intended to purify the said medium of the radioelements contained therein, may be that ordinarily practiced in LETPs (Liquid Effluent Treatment Plants) of nuclear power stations, in which, depending on the case, the operations of precipitating the dissolved elements, neutralizing the liquids, evaporating the water and drying of the precipitates are carried out.

DESCRIPTION OF ONE PARTICULAR EMBODIMENT OF THE INVENTION

Example

Figure 1:
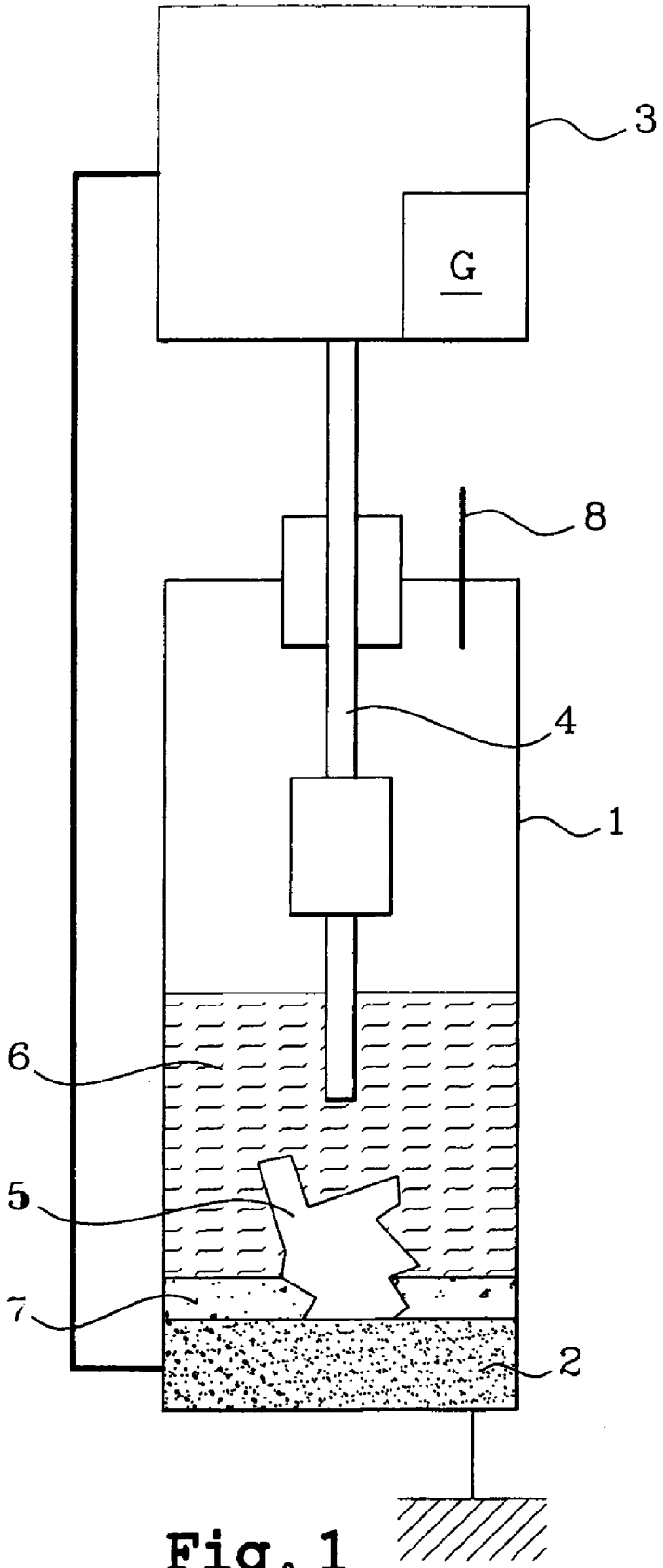
FIG. 1 shows one particular device for milling a conducting carbon material.

FIG. 1 illustrates a particular device used within the context of this example.

This device comprises a sealed reactor 1 made of non-conducting material, for example polyethylene. The bottom of the reactor is a conducting plate, constituting the earth electrode 2 connected to a high-voltage generator 3, of the Marx generator type. This generator supplies a high-voltage electrode 4, the distance of which from the earth electrode 2 can be adjusted. A block of nuclear graphite 5 rests on the bottom of the reactor, the said block being completely immersed in a liquid medium 6. High-voltage pulses are directed substantially towards the block 5, thus releasing fragments 7 of the said initial block 5. The high-voltage pulses are produced in the form of electric arcs between the high-voltage electrode and the earth electrode, the potential difference applied between these two electrodes depending on the distance between these two electrodes.

A vent 8 for the gases possibly produced during the milling is provided so as to avoid any overpressure phenomenon.

A block of nuclear graphite, with a mass of around 60 g, is placed in the reactor described above. A Marx generator used delivers pulses of the order of 1 kJ at a frequency of 10 Hz and with a duration of 1 μs.

The block of nuclear graphite is covered with water so as to be completely immersed.

Two series of trials were carried out:

a first series in which the set number of pulses was 720; and a second series in which the set number of pulses was about 5000.

Figure 2:
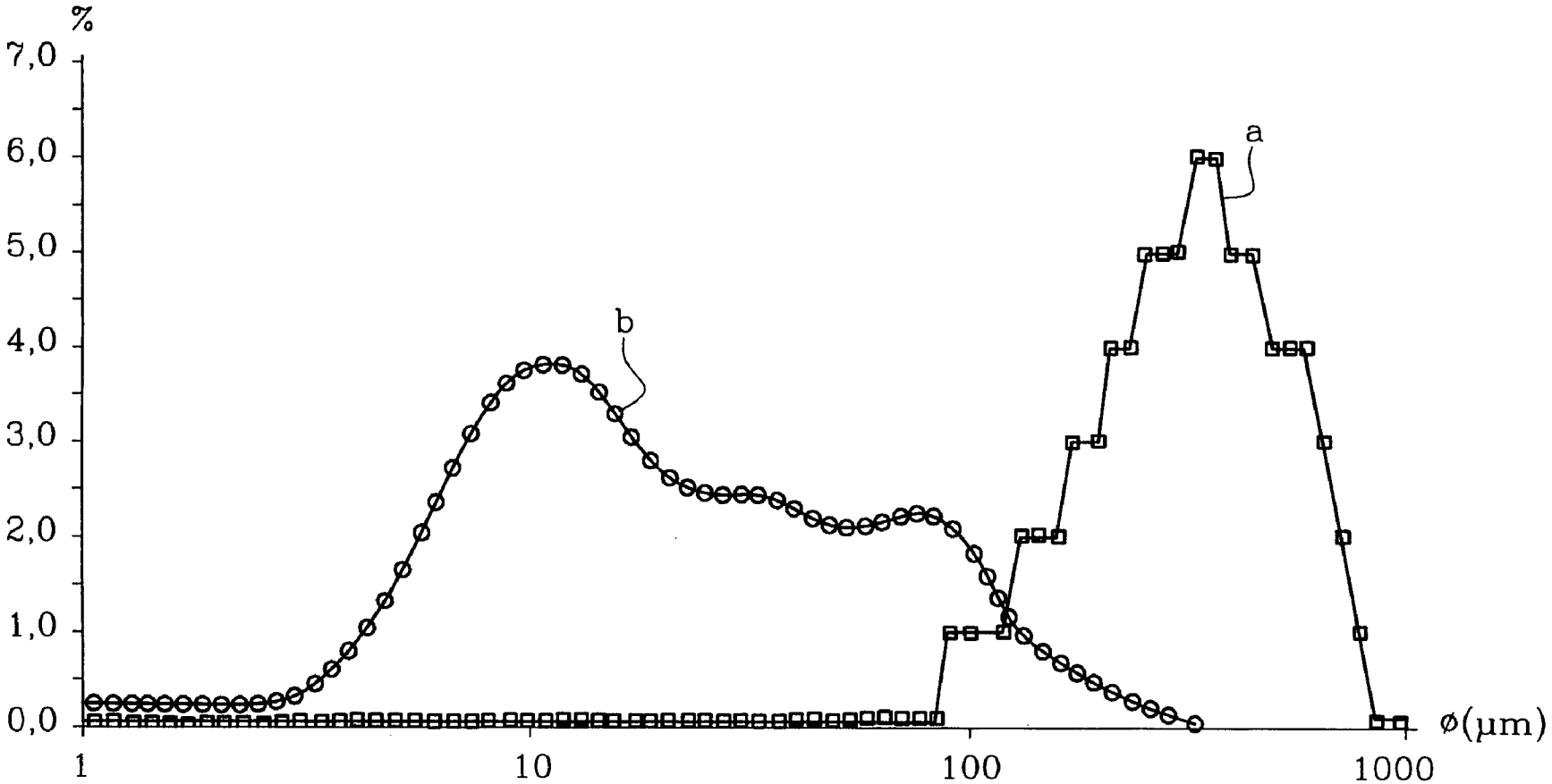
FIG. 2 illustrates the particle size curves for the graphite powders obtained in two trials carried out by applying, for each, a different number of pulses.

The results of these trials are plotted in FIG. 2, which shows the particle size distribution of the graphite powder obtained. The size Ø (in μm) of the graphite particles obtained is plotted on the x-axis of the graph, the scale being logarithmic, and the percentage % of the number of particles having a given size relative to the total number of particles is plotted on the y-axis of the graph. The sizes of the graphite particles obtained are determined using the Coulter method based on the principle of laser scattering. In this example, the sampling was taken only at the top of the reactor, without stirring the assembly.

Curve (a) shows the size distribution of the particles formed for 720 pulses, while curve (b) shows the distribution for about 5000 pulses.

As regards the trial with 720 pulses, a mean particle size of around 800 μm is obtained. As regards the trial with about 5000 pulses, a mean particle size of around 100 μm is obtained. These two trials clearly show that the effectiveness of the milling increases with the number of pulses.

Once the energy, frequency and duration of the pulses have been set, a person skilled in the art will, by experiment, set a suitable number of pulses depending on the desired particle size distribution.

The invention claimed is:

1. A process for the treatment of a nuclear graphite contaminated with radioelements, the process comprising:

milling the nuclear graphite contaminated with radioelements, immersed in a liquid medium comprising water, by subjecting the nuclear graphite to high-voltage pulses, the liquid medium having a resistivity such that, owing to the effect of the energy conveyed by the pulses, electric arcs are initiated which contact the nuclear graphite, the number of high-voltage pulses being set so as to obtain graphite particles of a given particle size;

purifying the liquid medium of the radioelements; and recovering the graphite particles.

2. The process according to claim 1, wherein the energy of the high-voltage pulses is from 10 J to 100 kJ.

3. The process according to claim 1, wherein the high-voltage pulses have a duration ranging from 200 ns to 100 μs.

4. The process according to claim 1, wherein the high-voltage pulses have a frequency ranging from 1 Hz to 1000 Hz.

5. The process according to claim 1, wherein the liquid medium is water.

6. A process for the treatment of a nuclear graphite contaminated with radioelements, the process comprising:

immersing in a liquid medium comprising water the nuclear graphite contaminated with radioelements; and milling the nuclear graphite contaminated with radioelements by subjecting the nuclear graphite to high-voltage pulses, the number of high-voltage pulses being set so as to obtain graphite particles of a given particle size;

wherein the liquid medium has a resistivity such that, owing to the effect of the energy conveyed by the pulses, electric arcs are initiated which contact the nuclear graphite.

* * * * *